US009298145B2

(12) United States Patent
Ishikuro

(10) Patent No.: US 9,298,145 B2
(45) Date of Patent: Mar. 29, 2016

(54) FUSER DEVICE AND IMAGE FORMING APPARATUS

(71) Applicant: Oki Data Corporation, Tokyo (JP)

(72) Inventor: Takemasa Ishikuro, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/603,971

(22) Filed: Jan. 23, 2015

(65) Prior Publication Data

US 2015/0212462 A1 Jul. 30, 2015

(30) Foreign Application Priority Data

Jan. 24, 2014 (JP) ..... 2014-011807

(51) Int. Cl.
*G03G 15/20* (2006.01)

(52) U.S. Cl.
CPC ..... *G03G 15/206* (2013.01); *G03G 15/2057* (2013.01)

(58) Field of Classification Search
CPC ..... G03G 15/2053; G03G 15/2057; G03G 15/206
See application file for complete search history.

(56) References Cited

U.S. PATENT DOCUMENTS

2005/0025539 A1* 2/2005 Yoshinaga ..... 399/329
2011/0103837 A1* 5/2011 Toyoda et al. ..... 399/174

FOREIGN PATENT DOCUMENTS

JP 2001-051535 A 2/2001

* cited by examiner

*Primary Examiner* — Gregory H Curran
(74) *Attorney, Agent, or Firm* — Muncy, Geissler, Olds & Lowe, P.C.

(57) ABSTRACT

A fuser device disclosed in the application, which fuses a developer to a medium, includes a first carrying part that contacts a surface of the medium on which the developer is transferred and carries the medium, a second carrying part that is positioned facing the first carrying part and carries the medium. A surface resistivity of the first carrying part is higher than a surface resistivity of the second carrying part.

19 Claims, 10 Drawing Sheets

FUSER DEVICE AND IMAGE FORMING APPARATUS

CROSS REFERENCE

The present application is related to, claims priority from and incorporates by reference Japanese Patent Application No. 2014-011807, filed on Jan. 24, 2014.

TECHNICAL FIELD

The present invention relates to a fuser device that fuses developer to a medium and an image forming apparatus.

BACKGROUND

Conventionally, an electrographic printer that forms an image with light emitting diode (LED) or laser has units for print medium feeding (print medium on which an image is formed), transferring, image formation, fusing, and ejection. The unit for fusing, which is a fuser part, fuses toner as developer formed in an image formation unit by applying heat and pressure to the toner. In recent years, in accordance with the increase of printing speed, a fuser belt that transfers the medium using applied pressure force is used in the fuser part while a large nip part is formed by a pressure application pad and a pressure application roller to make a period of time for heat application and a period of time for pressure application longer (see Japanese Laid-Open Application No. 2001-51535)

However, the conventional technology faces a problem that effects influencing image quality caused during fusing the developer should be diminished when a high image quality is required. The present invention objects to resolve such problem and reduce such effects that influence image quality during fusing.

SUMMARY

A fuser device disclosed in the application, which fuses a developer to a medium, includes a first carrying part that contacts a surface of the medium on which the developer is transferred and carries the medium, a second carrying part that is positioned facing the first carrying part and carries the medium. A surface resistivity of the first carrying part is higher than a surface resistivity of the second carrying part.

The present invention having such configuration has effects that are able to reduce the effects that influence image quality during fusing.

BRIEF EXPLANATIONS OF THE DRAWINGS

DETAILED EXPLANATION OF EMBODIMENT(S)

Figure 1:
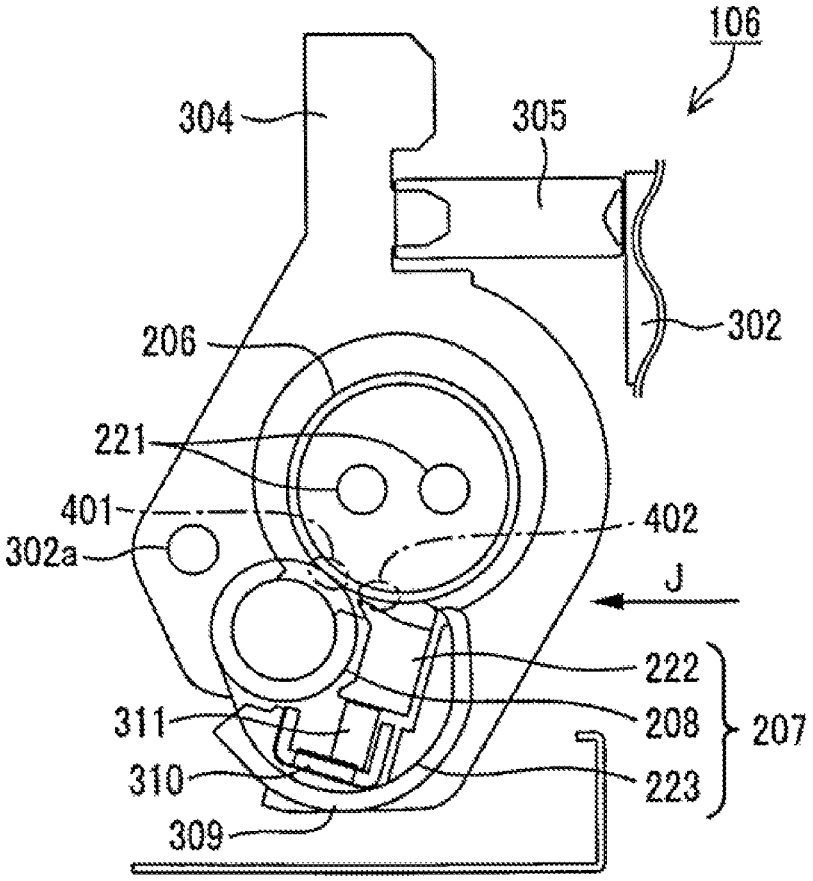
FIG. 1 is a schematic sectional view that shows a configuration of a fuser unit according to a first embodiment.

Hereinafter, embodiments of a fuser device and an image forming apparatus of the present invention are explained referring to the drawings.

First Embodiment

Figure 2:
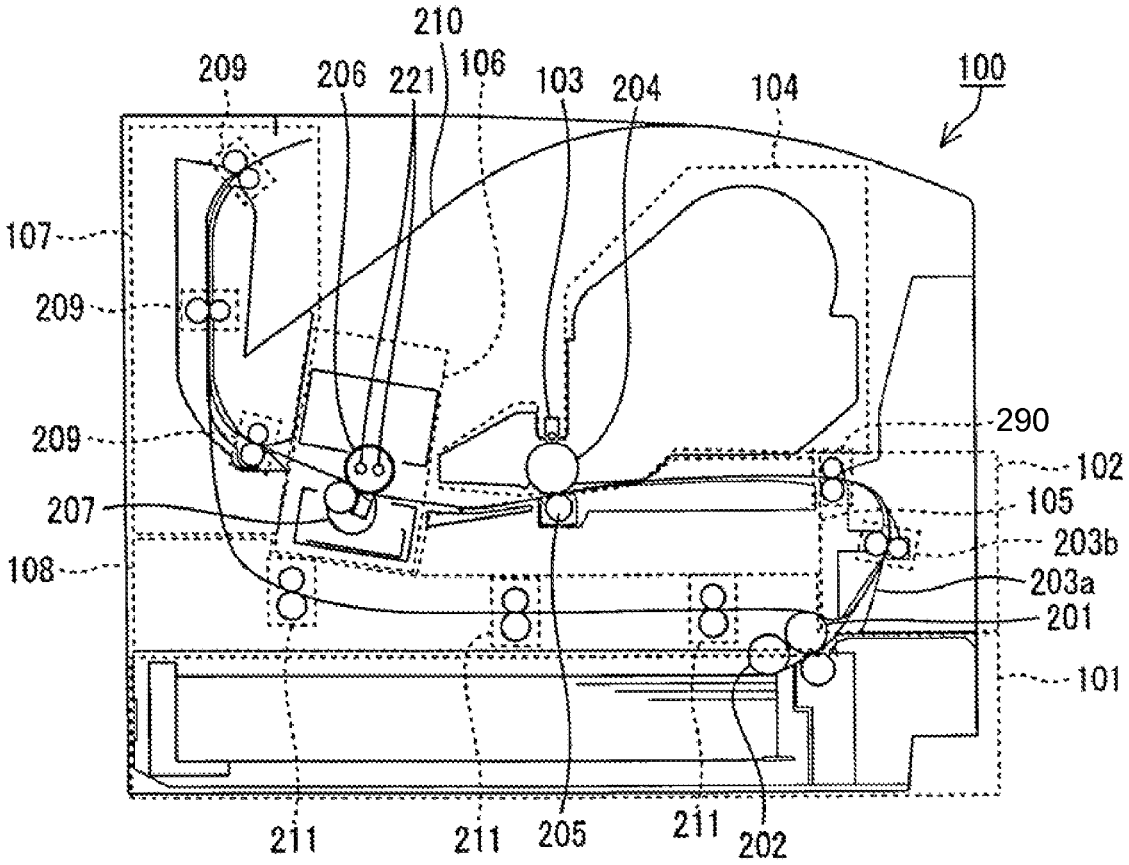
FIG. 2 is a schematic sectional view that shows a configuration of a printer according to the first embodiment.

FIG. 2 is a schematic sectional view that shows a configuration of a printer according to the first embodiment. In FIG. 2, a printer 100 as an image forming apparatus is provided with a sheet feeding cassette 101, a carrying part 102, an LED head 103, an ID unit 104, a transfer unit 105, a fuser unit 106, an ejection part 107, and a duplex carrying part 108. The sheet feeding cassette 101 contains medium on which a developer image is transferred and fused to perform printing, and is located in a lower portion of the apparatus. The sheet feeding roller 201 and the sheet feeding sub-roller 202 separate medium contained in the sheet feeding cassette 101, and carry the medium to the carrying part 102.

The carrying part 102 is provided with a medium carrying path 203*a* and a carrying roller 203*b*, and carries the medium to a registration part 290. The registration part 290 is formed of registration rollers for example, aligns edges of the carried medium, and carries the medium to the transfer unit 105. The LED head 103 is configured such that a photosensitive drum 204 is irradiated with light emitted by a light emitting element, and therefore an electrostatic latent image is formed on a surface of the photosensitive drum 204. The image drum (ID) unit 104 includes the photosensitive drum 204 as an image carrier. The ID unit 104 supplies toner as developer to the photosensitive drum 204 on which the electrostatic latent image is formed so that a toner image as a visualized electrostatic latent image is formed. The photosensitive drum 204 transfers the formed toner image to the medium and carries it.

The transfer unit 105 includes a transfer roller 205 located in a position that faces the photosensitive drum 204. In the transfer unit 105, in order to transfer the toner image visualized by the photosensitive drum 204 to the medium, a transfer voltage and pressure obtained by a pressure application member such as a spring are given to the transfer roller 205. Also, by the transfer roller 205, the medium is carried, the toner image is transferred to the medium, and the medium on which the toner image is transferred is carried to the fuser unit 106. In the present embodiment, a range of the transfer voltage applicable to the transfer roller 205 is 2 kV-6 kV, and a preferable range in a low humid condition is 3 kV-5 kV. The fuser unit 106 as a fuser device includes a fuser roller 206 (or a first carrying part), a pressure application part 207, and a heater 221, and fuses the transferred toner image to the medium.

The fuser roller 206 as a first carrying member contacts a surface of the medium on which the toner is transferred and carries the medium, and is configured of a hollow pipe core made of metal such as iron and aluminum and a surface layer that perfluoro alkoxyl alkane (PFA) or polytetrafluoroethylene (PTFE) are applied on a surface of the core. In the fuser roller 206, an inner surface of the hollow pipe core is heated by the heater 221 to melt unfused toner on an outer surface.

Figure 4A:
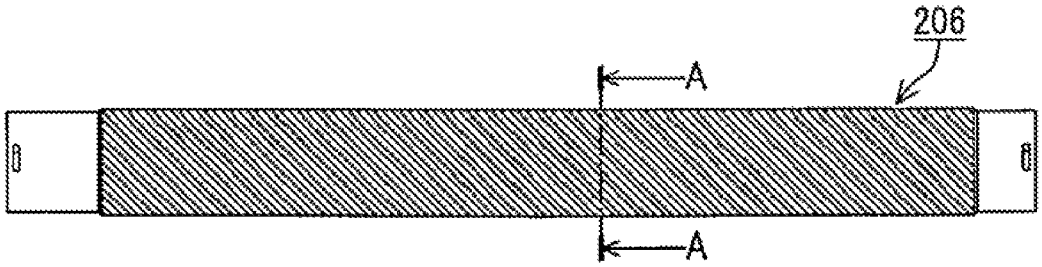
FIGS. 4A-4C are explanatory views that show a configuration of a fuser roller according to the first embodiment.
Figure 4B:
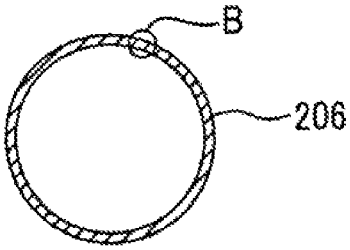
Figure 4C:
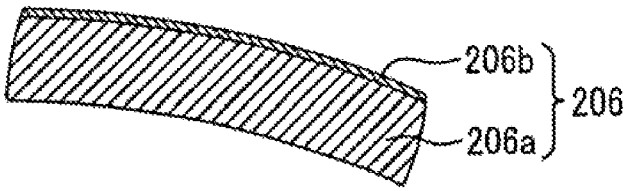

FIGS. 4A-4C are schematic sectional views that show a configuration of the fuser roller according to the first embodiment. FIG. 4A is a front view of the fuser roller 206. FIG. 4B is a sectional view cut along a line A-A of FIG. 4A. FIG. 4C is an enlarged view of a part B of FIG. 4B. In FIG. 4C, the fuser roller 206 is configured with a core part 206*a* and a surface layer 206*b*. For a fuser device that a start up time until print starts is important and a printer for mono color printing, it is good to use aluminum for the core part 206*a* as heat conductivity of aluminum is good so that it takes a shorter amount of time to heat to a print start temperature.

In the present embodiment, a core made of aluminum A5056 having a thickness of 1.5 mm is used. Also, for the surface layer 206*b*, a PFA coating of 30 μm is used. Moreover, a surface resistivity of the surface layer 206*b* is $1\times10^{9}$-$1\times10^{12}\Omega/\square$. In FIG. 2, the pressure application part 207 applies pressure to the fuser roller 206 to fuse toner melted by heat of the fuser roller 206 to the medium, and carries the medium to an ejection roller 209 of the ejection part 107.

The heater 221 is configured with a halogen lump, for example, and heats the fuser roller 206. The ejection part 107 has the ejection roller 209 and ejects the medium carried from the fuser unit 106 to a medium stacking part 210. Also, in a case that both-side printing is performed on the medium, when a sensor detects that a certain length of the medium has been carried, a rotating direction of the ejection roller 209 reverses to carry the medium to the duplex carrying part 108. The duplex carrying part 108 includes carrying rollers 211, and carries the medium to the carrying rollers 203*b* in the carrying part 102 and perform sheet feeding again. The medium stacking part 210 stacks a plurality of sheets of the medium ejected from the ejection part 107.

Figure 3:
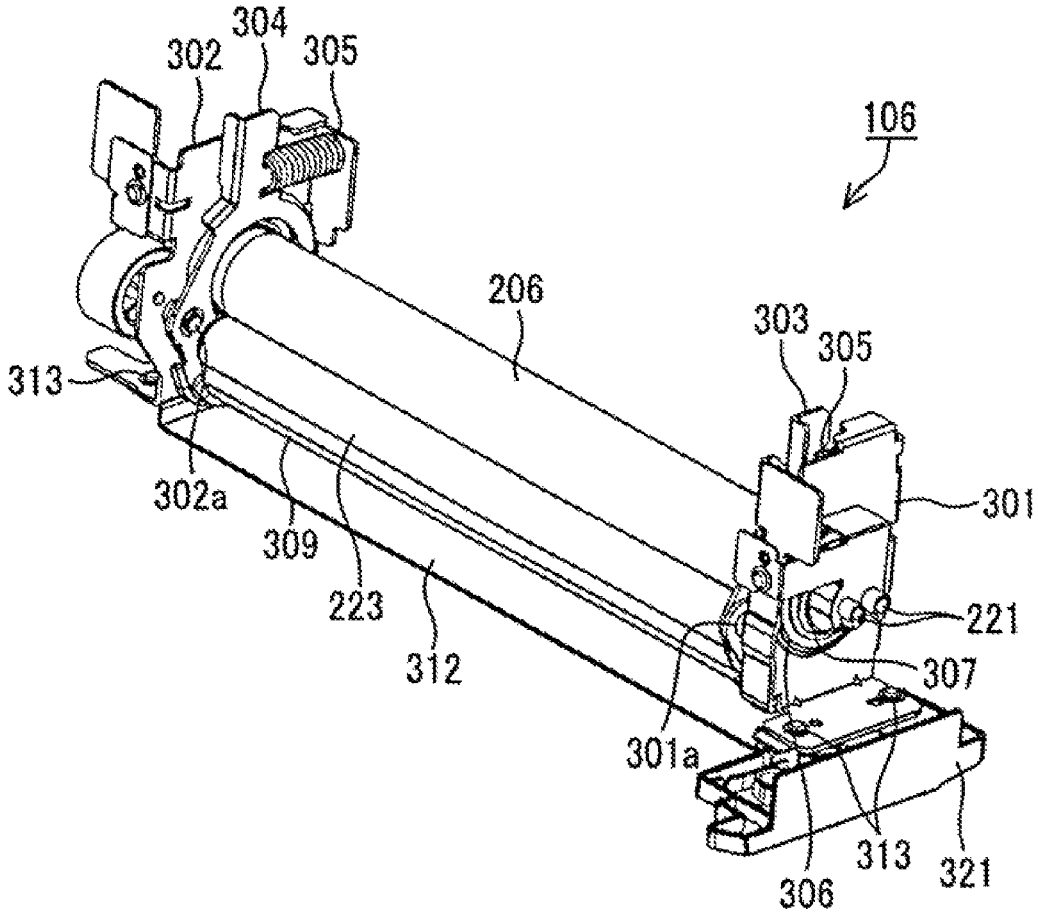
FIG. 3 is a schematic perspective view that shows a configuration of the fuser unit according to the first embodiment.

FIG. 3 is a schematic perspective view that shows a configuration of the fuser unit according to the first embodiment. FIG. 1 is a schematic sectional view that shows a configuration of the fuser unit according to the first embodiment. In FIG. 1 and FIG. 3, base plates 301 and 302 in the fuser unit 106 hold both end parts of the fuser roller 206 in an axis direction and sandwich pressure application levers 303 and 304. Because the fuser roller 206 is rotated with a gear by a driving part, the fuser roller 206 is sandwiched (pressed and held) with the bearings 306 and the sleeves 307 that are provided on the both end parts in the axis direction. Also, the metal plates 301 and 302 are connected by a metal plate 312 as a base plate and screws 313.

The bearings 306 reduce rotation load when the fuser roller 206 is driven. In the present embodiment, conductive lubricant is used for smoothly rotating balls inside. The sleeves 307 as resistant members are connected to the fuser roller 206, and are made of a conductive heat-resistant resin, for example, which is an insulator that prevents heat release via the bearings 306 from the aluminum core heated by the heater 221. In the present embodiment, a polyphenylene sulfide (PPS) composite resin is used, the resin having a base made of PPS and having a volume resistivity of $1\times10^{2}$~$10^{5}$ Ω·cm.

The pressure application part 207 in FIG. 1 is provided with an pressure application roller 208, an pressure application pad 222, and a fuser belt 223 (or second carrying part). Both end parts of the pressure application roller 208 in a axis direction are held by the pressure application levers 303 and 304. The fuser belt 223 as a second carrying member is positioned facing the fuser roller 206 through the medium and carries the medium. Also, the pressure application roller 208 and the pressure application pad 222 as pressure application members are positioned facing the fuser roller 206 through the fuser belt 223, and presses the fuser belt 223 to the fuser roller 206. Note, the fuser unit 106 is firmly attached to a metal plate member of the printer main body by a positioning member 321.

Figure 5A:
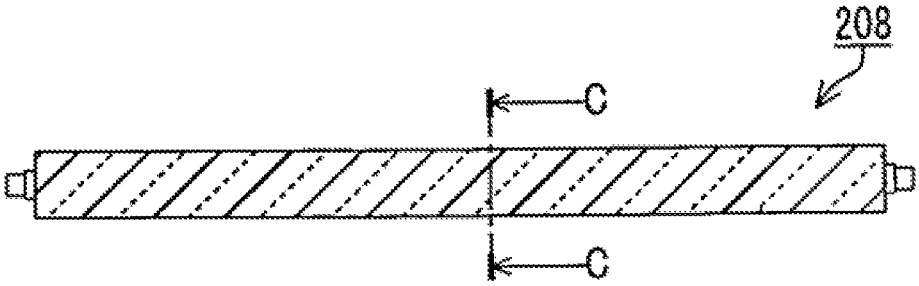
FIGS. 5A-5C are explanatory views that show a configuration of a pressure application roller according to the first embodiment.
Figure 5B:
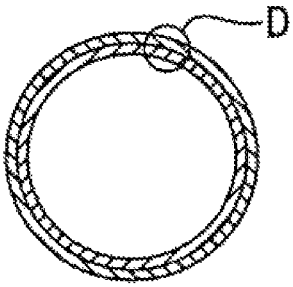
Figure 5C:
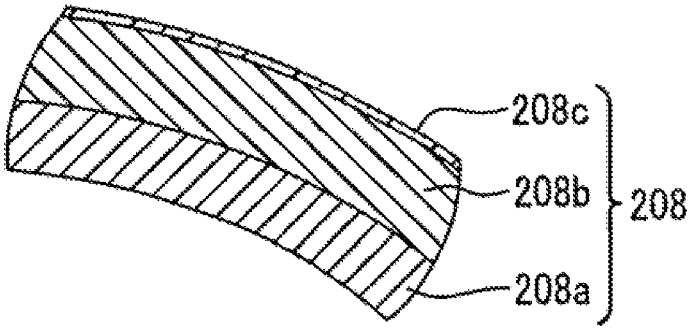

FIGS. 5A-5C are explanatory views that show a configuration of the pressure application roller according to the first embodiment. FIG. 5A is a front view of the pressure application roller 208. FIG. 5B is a cross-sectional view cut along line C-C of the pressure application roller 208 in FIG. 5A. FIG. 5C is an enlarged view of part D of the pressure application roller 208 in FIG. 5B. As illustrated in FIG. 5C, the pressure application roller 208 is configured of a core part 208*a*, an elastic layer 208*b*, and a coating layer 208*c*. The core part 208*a* is made of metal such as iron and has a hollow pipe shape. The elastic layer 208*b* is formed on a surface of the core part 208*a*, is made of silicon rubber, and is heat-resistant. The coating layer 208*c* is made of carbon and reduces separability with the fuser belt and friction with the fuser belt.

Figure 6A:
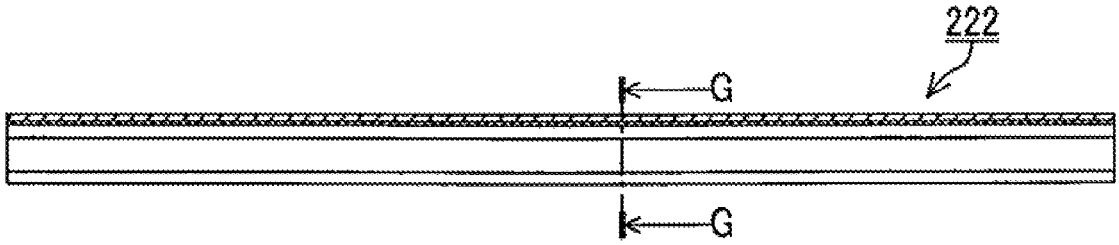
FIGS. 6A-6C are explanatory views that show a configuration of a pressure application pad according to the first embodiment.
Figure 6B:
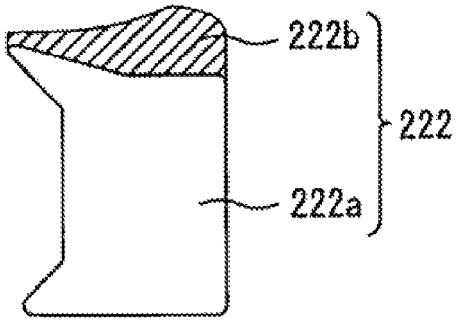
Figure 6C:
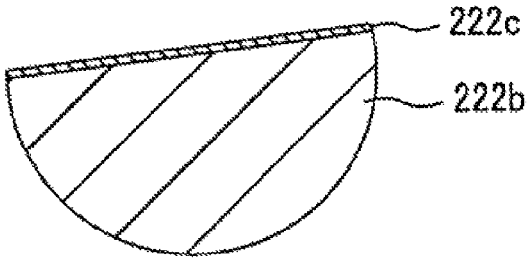

In FIG. 1 and FIG. 3, the pressure application roller 208 presses the fuser roller 206 with pressure obtained from the pressure application levers 303 and 304 by pressure application roller springs 305 via rotational fulcrums 301*a* and 301*b* of the metal plates 301 and 302. Also, the coating layer 208*c* in FIG. 5 has a conductivity that has a surface resistivity of $1\times10^{7}\Omega/\square$ or less. FIGS. 6A-6C are explanatory views that show a configuration of the pressure application pad according to the first embodiment. FIG. 6A is a front view of the pressure application pad 222. FIG. 6B is a cross sectional view cut along line GG of the pressure application pad 222 in FIG. 6A. FIG. 6C is an enlarged view of part H of the pressure application pad 222 in FIG. 6B.

As illustrated in FIG. 6, the pressure application pad 222 is configured of a support member 222*a*, an elastic layer 222*b*, and a coating layer 222*c*. The support member 222*a* is made of metal such as iron, aluminum and so on. The elastic layer 222*b* is heat resistant and is made of silicon rubber. The coating layer 222*c* is made of carbon and reduces separability with the fuser belt and friction with the fuser belt. In FIG. 1 and FIG. 3, the pressure application pad 222 is positioned on an upstream side of the medium carrying direction with respect to the pressure application roller 208, the medium carrying direction being indicated by an arrow J in the figure. Also, the pressure application pad 222 presses the fuser roller 206 using a pad spring 311 arranged on a metal plate 310 sandwiched by the pressure application levers 303 and 304. Also, the coating layer 222*c* in FIG. 6 has a conductivity having a volume resistivity of $1\times10^{7}\Omega/\square$.

Figure 7A:
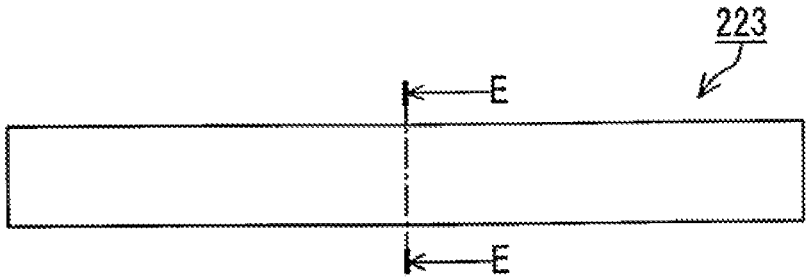
FIGS. 7A-7C are explanatory views that show a configuration of a fuser belt according to the first embodiment.
Figure 7B:
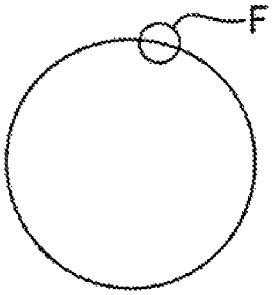
Figure 7C:
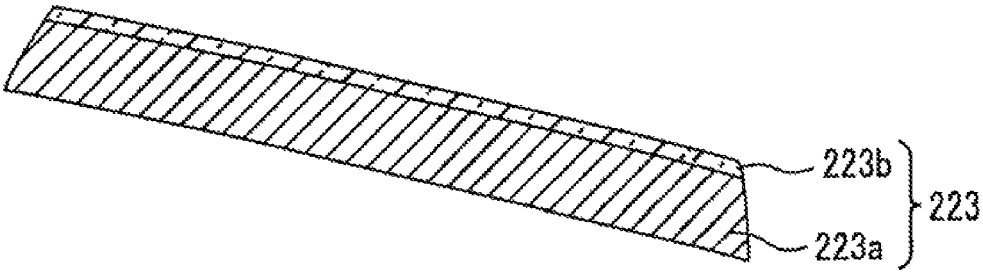

FIGS. 7A-7C are explanatory views that show a configuration of a fuser belt according to the first embodiment. FIG. 7A is a front view of the fuser belt 223. FIG. 7B is a cross sectional view cut along line EE of the fuser 223 in FIG. 7A. FIG. 7C is an enlarged view of the part F of the fuser belt 223 in FIG. 7B. As illustrated in FIG. 7, the fuser belt 223 is an endless film that is made of a base layer 223*a* made of polyimide for example and a separation layer 223*b* formed on the base layer 223*a*. The separation layer 223*b* is coated with an antistatic agent, and has a conductivity having a volume resistivity of $1\times10^{7}\Omega/\square$.

In FIG. 1 and FIG. 3, the fuser belt 223 is suspended by belt guide members 308 and 309, the pressure application roller 208, and pressure application pad 222, the belt guide members 308 and 309 being firmly attached to the pressure application levers 303 and 304. The fuser belt 223 is configured to form a first nip part 401 and a second nip part 402. The first nip part 401 is sandwiched by the fuser roller 206 and the pressure application roller 208. The second nip part 402 is sandwiched by the fuser roller 206 and the pressure application pad 222.

Because the two nip parts are formed by the pressure application pad 222 and the pressure application roller 208, for example, a further large amount of heat can be given to the medium in the first nip part 401 sandwiched by the fuser roller 206 and the pressure application roller 208. Therefore, some advantages are obtained such as a fuser temperature of the fuser unit 106 can be decreased and printing in a higher speed can be performed.

Further, when it is configured that bias force (pressure) of the pressure application roller 208 to the fuser roller 206 at the first nip part is larger than bias force (pressure) of the pressure application pad 222 to the fuser roller 206 at the second nip part 402, pressure to the toner on the medium on a medium upstream side of the fuser unit 106 is higher than pressure on a medium downstream side. Therefore, an advantage that toner is efficiently effectively fused is obtained.

Figure 8:
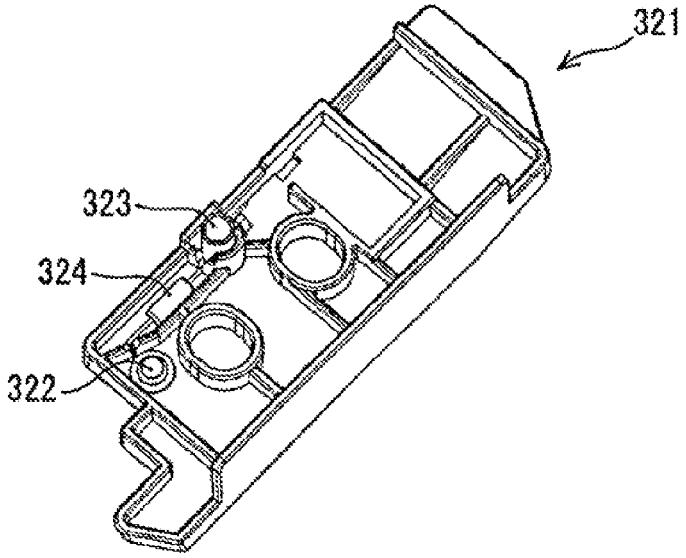
FIG. 8 is a schematic perspective view of a positioning member according to the first embodiment.

FIG. 8 is a schematic perspective view of the positioning member according to the first embodiment. The positioning member 321 in FIG. 8 is a member for positioning the fuser unit 106 to be attached to the printer as illustrated in FIG. 3, and is firmly attached to the metal plate on a printer main body side by the screws 322. A spring 323 is a compressed spring. One end part of the spring contacts one end of a resistor 324, and another end part thereof contacts the metal plate 312 when the fuser unit 106 is attached.

The resistor 324 gives high resistance such that electrical charge applied by the transfer roller 205 on the medium is not discharged when the medium goes through the fuser unit 106. The one end contacts the one end of the spring 323, and the other end is connected to the metal plate 312 by the screws 322. The metal plate 312 of the fuser unit 106 is grounded via the resistor 324 to the printer main body side. For the resistor 324, a 100 MΩ resistor is used.

Figure 9:
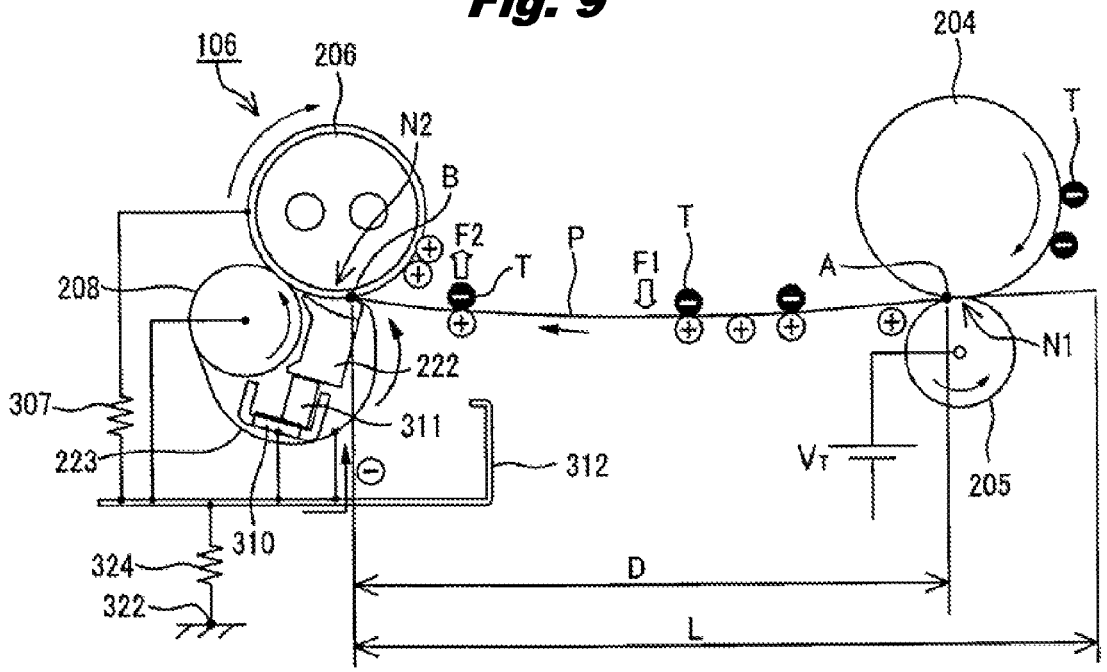
FIG. 9 is an explanatory view of the fuser unit according to the first embodiment.
Figure 10:
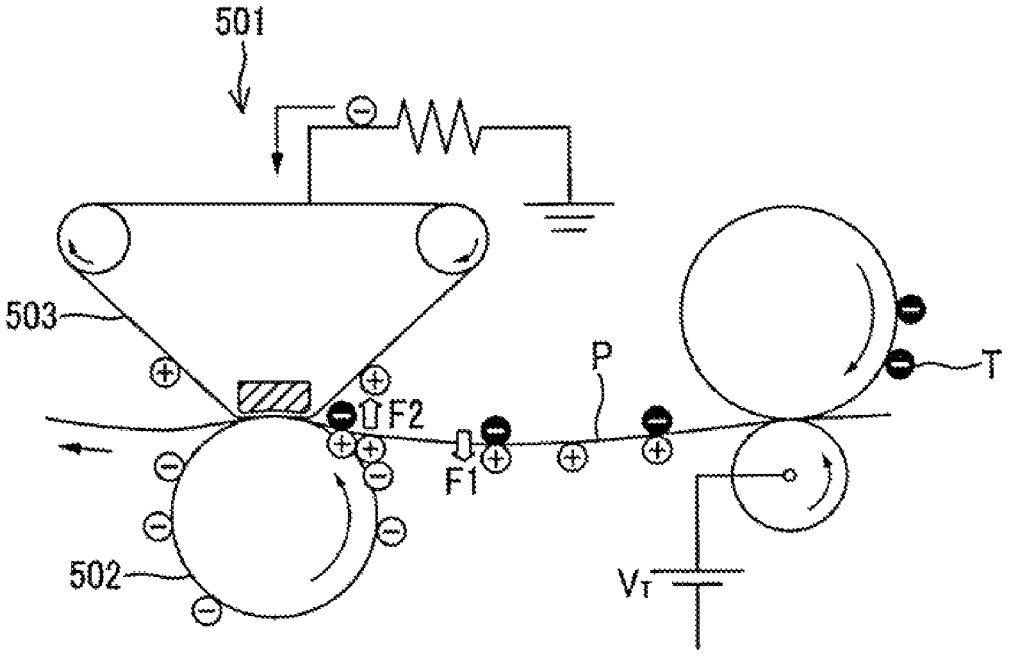
FIG. 10 is an explanatory view of a fuser unit according to a comparative example.

FIG. 9 is an explanatory view of the fuser unit according to the first embodiment. In FIG. 9, a surface layer end part of the fuser roller 206 of the fuser unit 106 is connected to the metal plate 312 via the sleeve 307 as a resistor member, an axis end part of the pressure application roller 208 and an end part of the fuser belt 223 are connected to the metal plate 312, the pressure application pad 222 is connected to the metal plate 312 via the metal plate 310 and the pad spring 311 illustrated in FIG. 1, and the metal plate 312 is grounded via the resistor 324. A positive voltage $V_T$ is applied to the transfer roller 205.

A length of a medium P in the medium carrying direction illustrated by an arrow in FIG. 9 is represented as L. A distance between a downstream end A and an upstream end B is represented as B. The downstream end A is one end of a contact part N1 of the photosensitive drum 204 and the transfer roller 205 in the medium carrying direction and the upstream end B is one end of the nip part N2 of the fuser unit 106 in the medium carrying direction. Then, the photosensitive drum 204, the transfer roller 205, and the fuser unit 106 are arranged to have a positional relationship of L>D. As described above, in the present embodiment, the surface layer end part of the fuser roller 206 is grounded via the metal plate 312 and the end part of the fuser belt 223 is grounded via the metal plate 312. Therefore, by changing the surface resistivity of the fuser roller 206 and the fuser belt 223, electrical charge of the surfaces of the fuser roller 206 and the fuser belt 223 are stabilized.

In the present embodiment, measurement of the surface resistivity was performed using a Resistivity Meter Loresta GP (Mitsubishi Chemical Analytech). As illustrated in Table 1 below, in the fuser roller 206, a voltage of 250V was applied for 10 seconds, and after that, one point between two arbitrary points on the surface was measured. Also, in the fuser belt 223, the pressure application roller 208, and the pressure application pad 222, a voltage of 100V was applied for 10 seconds, and after that, respective one points of the between two arbitrary points on the surface were measured

TABLE 1

| | Applied Vol. | Time | Measurement Point |
|---|---|---|---|
| Fuser Roller | 250 V | 10 Sec. | 1 Point |
| Fuser Belt | 100 V | 10 Sec. | 1 Point |
| Pressure Application Roller | 100 V | 10 Sec. | 1 Point |
| Pressure Application Pad | 100 V | 10 Sec. | 1 Point |

An explanation of functions of the above described configuration is given. Fuser operation performed by a printer is explained based on FIG. 9 as referring to FIG. 2 and FIG. 3. A medium fed from the sheet feeding cassette 101 by the sheet feeding roller 201 and the sheet feeding sub-roller 202 is carried to the registration part 290, front end thereof is aligned by the registration rollers, then the medium is faced by the photosensitive drum 204 and the transfer roller 205 and is carried to a contacted nip position. On the photosensitive drum 204 on which an electrostatic latent image is formed by the LED head 103, negatively charged toner T is supplied from an ID unit 104, and then a visualized toner image is formed on the photosensitive drum 204.

A positive voltage is applied by the transfer roller 205 to the medium that has reached the nip position, and the negatively charged toner T on the photosensitive drum 204 is transferred to the medium P. The medium P is carried to the fuser unit 106 by the photosensitive drum 204 and the transfer roller 205, and then the toner T is melted and fused on the medium P by heat from the heater 211 disposed inside the fuser roller 206. At this time, the fuser belt 223 of the fuser unit 106 is negatively charged by rotational sliding. However, because the fuser belt 223 is coated with the antistatic agent, negative electrical charge on the fuser belt 223 is flown toward the ground direction, so that negative charge doesn't get large. Also, positive charge on a back surface (surface on the transfer roller 205 side) of the medium P is offset by negative charge flown from the metal plate 312 by contacting with the conductive fuser belt 223.

As described above, in the present embodiment, the volume conductivity of the conductive fuser belt 223 is set to be lower than the volume conductivity of the fuser roller 206, in other words, the volume conductivity of the fuser roller 206 is set to be higher than the volume conductivity of the fuser belt 223, and as the result, an electrical potential of the surface of the fuser belt 223 is stabilized. Also, force F2 that pulls negatively charged toner T to the fuser roller 206 doesn't become larger than force F1 that keeps the toner T to the medium. As a result, it prevents the toner T from adhering to the fuser roller 206, and a stable image printing that offset residual image is not generated, the offset residual image being generated when the toner T adheres to the fuser roller 206. Note, the offset residual image means disorder of the image that is made when negatively charged toner T transferred on the medium P adheres to the positively charged fuser roller 206 during fusing and the toner T adhering to the fuser roller 206 adheres to the carrying medium P when the fuser roller 206 rotates.

Figure 11:
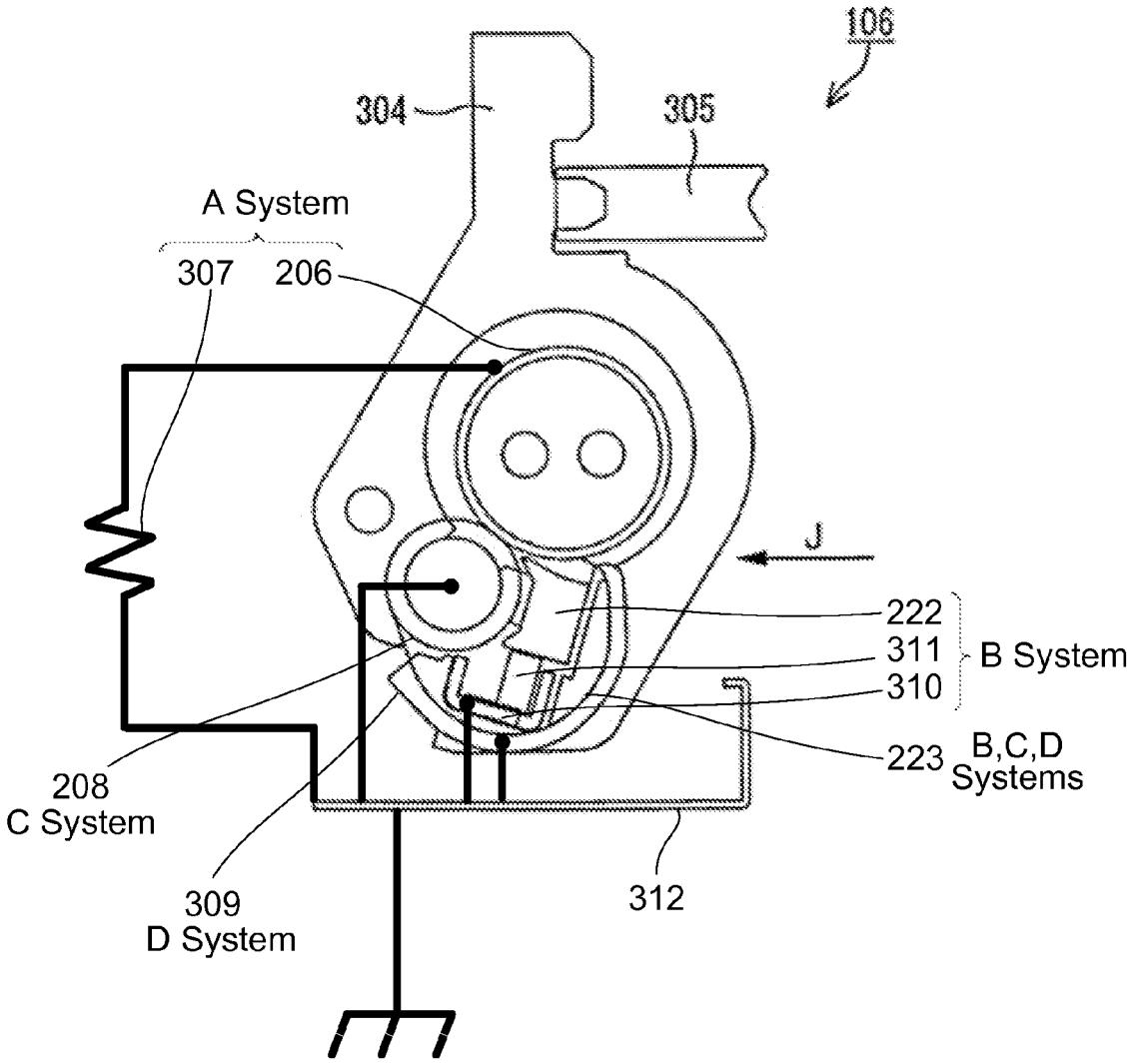
FIG. 11 is a schematic sectional view that shows a modified configuration of the fuser unit, which illustrates four connection systems (A-D system).

Herein, a fusing operation of a comparative example is explained based on FIG. 11 that is an explanatory view of a fuser unit of a comparative example. In FIG. 11, the medium P on which the toner T is transferred is carried to a fuser unit 501, and then the toner T is melted and fused on the medium P by heat from a heated fuser belt 503. At this time, a surface of the pressure application roller 502 of the fuser unit 501 is negatively charged by rotational sliding. Also, positive charge on a back surface (surface on a transfer roller side) of the medium P is offset by negatively charged electrical charge by contacting with the pressure application roller 502.

As described above, when positive charge on the back surface (surface on the transfer roller side) of the medium P is offset by negative charge of the pressure application roller 502, force F2 that pulls negatively charged toner T becomes larger than force F1 that keeps the toner T to the medium P. As a result, the toner T becomes less likely to adhere to the fuser belt 503 and offset residual images are more likely to be generated because the toner T adheres to the fuser belt 503. Especially in duplex printing, after first time of printing, the volume resistivity of the medium P becomes large and a potential difference between a front surface and a back surface becomes large. As a result, at second time of printing, the force F2 that pulls the toner T to the fuser belt 503 becomes larger than the force F1 that keeps the toner T to the medium P, and the toner T is more likely to adhere to the fuser belt 503, so that offset residual images are more likely to be generated.

In the present embodiment, because the surface resistivity of the fuser roller 206 is set to be larger than the surface resistivity of the fuser belt 223, even during duplex printing, the force F2 that pulls the negatively charged toner doesn't get larger than the force F1 that keeps the toner to the medium P. As a result, stably printed images that offset residual images are not generated can be obtained. Furthermore, in the present embodiment, a correlation between the surface resistivity of the fuser roller 206 and the surface resistivity of the fuser belt 223 is explained. The surface resistivity of the fuser roller 206 is represented as R1, and the surface resistivity of the fuser belt 223 is represented as R2. Continuous printing was performed. Offset residual and transfer leakage generated in the printing result was evaluated, and the evaluation result is explained based on Table 2 below.

TABLE 2

| | | | Surface Resistivity of Fuser Roller (R1) | | | |
|---|---|---|---|---|---|---|
| | | | $R1 \leq 10^7$ | $10^7 < R1 < 10^9$ | $10^9 \leq R1 \leq 10^{12}$ | $10^{12} < R1$ |
| Surface Resistivity of Fuser Belt (R2) | Offset | $R2 \leq 10^7$ | ○ | ○ | ○ | Δ |
| | Transfer Leakage | | X | Δ | ○ | ○ |
| | Offset | $10^7 < R2$ | Δ | X | X | X |
| | Transfer Leakage | | X | Δ | Δ | Δ |

Note, the transfer leakage means disorders of images that are generated when the negatively charged fuser roller 206 sprays negatively charged toner to the medium P. More specifically, as illustrated in FIG. 9, when the medium P is held at both the nip part N2 of the fuser unit 106 and the contact part N1 of the photosensitive drum 204 and the transfer roller 205, a current flows toward the fuser roller 206 side via the medium P due to the voltage applied to the transfer roller 205, and this causes the toner to be sprayed. As a result, the transfer leakage occurs.

As illustrated in Table 2, when the surface resistivity R1 of the fuser roller 206 was set to be $1\times10^9<R1<1\times10^{12}\Omega/\square$ and the surface resistivity R2 of the fuser belt 223 was set to be $1\times10^7\Omega/\square$, offset residual and transfer leakage didn't occur, and preferable printing images was able to obtained. Note, in Table 2, "○" means that very good printing images were obtained and occurrence of offset residual or transfer leakage was not confirmed; "Δ" means that good printing images were obtained but occurrence of offset residual and transfer leakage was confirmed; and "x" means that poor printing images were obtained and occurrence of offset residual and transfer leakage was confirm.

In order to reduce the transfer leakage, it is required to set the surface resistivity of the fuser roller 206 to be higher than that of the fuser belt 223 and also to set a surface resistivity low, the surface resistivity being for grounding from the fuser belt 223, as the conductivity of the fuser belt 223 is set high. On the other hand, in order to reduce the offset residual, it is required to set the surface conductivity high enough to give certain strength of conductivity to the fuser roller 206. In fusing of the toner to the medium, with respective to fusing performance, influence of the transfer leakage is superior in Table 2. Therefore, certain effect for reducing the transfer leakage can be obtained by setting the surface resistivity of the fuser roller 206 higher than the surface resistivity of the fuser belt 223.

On the other hand, when the surface resistivity R1 of the fuser roller 206 is set to be $1\times10^9<R1<1\times10^{12}\Omega/\square$ and the surface resistivity R2 of the fuser belt 223 is set to be $1\times10^7\Omega/\square$ or less, a very good result with respect to the offset residual can be obtained. As described above, when the surface resistivity R1 of the fuser roller 206 is set to be $1\times10^9<R1<1\times10^{12}\Omega/\square$ and the surface resistivity R2 of the fuser belt 223 is set to be $1\times10^7\Omega/\square$ or less, occurrence of offset residual and transfer leakage wasn't confirmed and very good printing images were able to obtained.

As described above, in the first embodiment, the surface resistivity of the fuser roller is set to be higher than the surface resistivity of the fuser belt, and thereby effects on image quality during fusing is decreased. Also, when the surface resistivity R1 of the fuser roller is set to be $1\times10^9<R1<1\times10^{12}\Omega/\square$ and the surface resistivity R2 of the fuser belt is set to be $1\times10^7\Omega/\square$ or less, very good printing images are able to obtained.

(Connection Systems)

In addition to the first embodiment, the present invention can be modified to include four connection systems (A to D systems) each of which is grounded through the metal plate 312 as a base plate, see FIG. 11. A-system denotes a connection from the fuser roller 206 to the metal plate 312. B, C and D-systems denote connections from the fuser belt 223 to the metal plate 312. A-system may be referred as a first connection system. B-system may be as a second connection system. C-system may be as a third connection system. D-system may be as a fourth connection system. In the modified embodiment, the four systems are described below.

Here are four systems described:

(A-System)

A-system comprises the fuser roller 206 and sleeves 307 that are electrically connected. The sleeves 307 is positioned between the fuser roller 206 and the metal plate 312. A total resistance of A-system is a resistance value that is determined between the surface of the fuser roller 206 and the metal plate 312 under a condition where the fuser roller 206 does not contact to the fuser belt 223.

(B-System)

B-system comprises the fuser belt 223, the pressure application pad 222, the pad spring 311 and the metal plate 310 that are electrically connected. In the embodiment, as shown in FIG. 11, the metal plate 310 is connected to the metal plate 312 for the ground. A total resistance of B-system is a resistance value that is determined, under the condition where the fuser roller 206 does not contact to the fuser belt 223, between the surface of the fuser belt 223 and the metal plate 312 assuming that no C-system or D-system exists.

(C-System)

C-system comprises the fuser belt 223 and the pressure application roller 208 that are electrically connected. A total resistance of C-system is a resistance value that is determined, under the condition where the fuser roller 206 does not contact to the fuser belt 223, between the surface of the fuser belt 223 and the metal plate 312 assuming that no B-system or D-system exists.

(D-System)

D-system comprises the fuser belt 223 and the belt guide member 309 that are electrically connected. The total resistance of D-system is a resistance value that is determined, under the condition where the fuser roller 206 does not contact to the fuser belt 223, between the surface of the fuser belt 223 and the metal plate 312 assuming that no B-system or C-system exists.

Herein, the total resistance of A-system is greater than any of the total resistances of B-system, C-system, and D-system. In other words, it is preferred that any of the total resistances of B-system, C-system, or D-system is smaller that the total resistance of A-system. With such a structure, it can be achieved to reduce the deterioration of the image qualities or grades at the fusing.

Second Embodiment

In a second embodiment, a surface resistivity of the PFA coating layer 206*b* of the fuser roller 206, illustrated in FIG. 1 and FIG. 4, was set to be $1\times10^4$~$1\times10^6\Omega/\square$, which is conductive. Also, for the sleeve 307 as a resistor member, a resistor whose volume resistivity is $1\times10^2$~$1\times10^3$ $\Omega\cdot$cm, which has a small apparent surface resistivity, was used to obtain good conductivity and to make the difference between the surface resistivities of the fuser roller 206 and the fuser belt 223 small. As described above, in the present embodiment, differences between apparent surface resistivities of the fuser roller 206 and the sleeve 307 and the surface resistivity of the fuser belt 223 were set to be $1\times10^2\Omega/\square$ or less.

In the application, the apparent surface resistivity is obtained by dividing a volume resistivity of a material with an average thickness of the material. However, it can be obtained by considering its material characters as well. The apparent surface resistivity of the sleeve 307 was obtained by dividing a volume resistivity of the sleeve 307 with an average thickness of the sleeve 307. The apparent surface resistivity of fuser roller 206 was obtained by dividing a volume resistivity of the fuser roller 206 with an average thickness of the fuser roller 206.

Also, a surface resistivity of the separation layer 223*b* of the fuser belt 223 illustrated in FIG. 7 was set to be $1\times10^7\Omega/\square$ or less, which is conductive as the same as the first embodiment. Note, the other configurations of the second embodiment are the same as the configurations of the first embodiment, so that the same reference numbers are given and explanations thereof are omitted. Functions of the above described configuration are explained. In the present embodiment, during rotational sliding of the fuser belt 223 illustrated in FIG. 1, FIG. 3 and FIG. 9, exchange of charge between the fuser roller 206 and the fuser belt 223 is more likely to occur. Therefore, even when volume resistivity of the medium P become large, it is possible to receive charge from the fuser roller 206 and the fuser belt in accordance with surface potential of the medium P. Furthermore, the offset residual images are not generated and further stable very good printing result can be obtained.

As described above, in the second embodiment, in addition to the effect of the first embodiment, the difference between the surface resistivities of the fuser roller 206 and the fuser belt 223 was set small, and therefore it is possible to obtain further stable very good printing result. In the first embodiment and second embodiment, as an image forming apparatus, an electrophotographic system printer in a LED tandem type is explained, however, it is not limited to this and laser type printer, intermediate transfer type printer, etc may be used. Also, for the fuser device, either an upper belt type, a lower belt type, and IH fusing type may be used.

What is claimed is:

1. A fuser device that fuses a developer to a medium, comprising:

a first carrying part that contacts a surface of the medium on which an unfixed developer is held and that carries the medium;

a second carrying part that is positioned facing the first carrying part and carries the medium, wherein a surface resistivity of the first carrying part is higher than a surface resistivity of the second carrying part, the second carrying part is a belt member, and the surface resistivity of the second carrying part is $1\times10^7\Omega/\square$ or less.

2. The fuser device according to claim 1, wherein the surface resistivity of the first carrying part is $1\times10^9$~$1\times10^{12}\Omega/\square$.

3. The fuser device according to claim 1, wherein the first carrying part is a fuser roller.

4. An image forming apparatus, comprising:

the fuser device according to claim 1.

5. The fuser device according to claim 1, further comprising:

a pressure application part that presses the second carrying part to the first carrying part.

6. The fuser device according to claim 5, wherein the pressure application part is a pressure application pad.

7. The fuser device according to claim 1, further comprising:

a base plate that is grounded to the earth, wherein the first carrying part and the second carrying part are electrically connected to the base plate.

8. The fuser device according to claim 7, wherein the first carrying part is electrically connected to the base plate through a resistance material that is different from a resistance material through which the second carrying part is electrically connected to the base plate.

9. The fuser device according to claim 8, wherein a total resistance through a first connection system is greater than a total resistance through a second connection system, where the first connection system is defined by a connection between the first carrying part and the base plate, and the second connection system is defined by the connection between the second carrying part and the base plate.

10. A fuser device that fuses a developer to a medium, comprising:

a first carrying part that contacts a surface of the medium on which an unfixed developer is held and that carriers the medium;

a second carrying part that is positioned facing the first carrying part and carries the medium; and a pressure application part that presses the second carrying part to the first carrying part, wherein a surface resistivity of the first carrying part is higher than a surface resistivity of the second carrying part, and a surface resistivity of the pressure application part is $1\times10^{7}\Omega/\square$ or less.

11. The fuser device according to claim 10, wherein the surface resistivity of the first carrying part is $1\times10^{9}\sim1\times10^{12}\Omega/\square$.

12. The fuser device according to claim 10, wherein the surface resistivity of the second carrying part is $1\times10^{7}\Omega/\square$ or less.

13. The fuser device according to claim 10, wherein the first carrying part is a fuser roller.

14. The fuser device according to claim 10, wherein the second carrying part is a belt member.

15. The fuser device according to claim 10, wherein the pressure application part is a pressure application pad.

16. An image forming apparatus, comprising:

the fuser device according to claim 10.

17. The fuser device according to claim 10, further comprising:

a base plate that is grounded to the earth, wherein the first carrying part and the second carrying part are electrically connected to the base plate.

18. The fuser device according to claim 17, wherein the first carrying part is electrically connected to the base plate through a resistance material that is different from a resistance material through which the second carrying part is electrically connected to the base plate.

19. The fuser device according to claim 18, wherein a total resistance through a first connection system is greater than a total resistance through a second connection system, where the first connection system is defined by a connection between the first carrying part and the base plate, and the second connection system is defined by the connection between the second carrying part and the base plate.

* * * * *